United States Patent [19]

Martin

[11] Patent Number: 4,716,667

[45] Date of Patent: Jan. 5, 1988

[54] EXCAVATING TOOTH AND WEAR CAP ASSEMBLY

[75] Inventor: Wesley E. Martin, Carrollton, Tex.

[73] Assignee: GH Hensley Industries, Inc., Dallas, Tex.

[21] Appl. No.: 912,330

[22] Filed: Sep. 25, 1986

[51] Int. Cl.[4] ..... E02F 9/28

[52] U.S. Cl. ..... 37/142 R; 172/772

[58] Field of Search ..... 37/141 R, 141 T, 142 R, 37/142 A; 172/772, 772.5, 699, 700

[56] References Cited

U.S. PATENT DOCUMENTS

| | | | |
|---|---|---|---|
| 1,775,984 | 9/1930 | Younie . | |
| 2,674,816 | 4/1954 | Daniels et al. | 37/142 |
| 2,762,139 | 9/1956 | Launder | 37/142 |
| 2,896,345 | 1/1959 | Peklay | 37/142 |
| 2,968,880 | 1/1961 | Petersen | 37/142 A |
| 2,982,035 | 5/1961 | Stephenson | 37/142 |
| 3,020,655 | 2/1962 | Launder | 37/142 |
| 3,082,555 | 3/1963 | Hill | 37/142 |
| 3,126,654 | 3/1964 | Eyolfson et al. | 37/142 |
| 3,137,352 | 6/1964 | Petersen | 37/142 A X |
| 3,160,967 | 12/1964 | Nichols | 37/141 |
| 3,426,459 | 2/1969 | Petersen | 37/142 |
| 3,489,226 | 1/1970 | McKean | 172/772 X |
| 3,496,658 | 2/1970 | Eyolfson | 37/142 |
| 3,536,147 | 10/1970 | Norton et al. | 37/142 R X |
| 3,774,324 | 11/1973 | Lafond | 37/142 |
| 3,845,578 | 11/1974 | Holmstrom | 37/142 R X |
| 3,919,792 | 11/1975 | Hahn et al. | 37/142 |
| 3,999,614 | 12/1976 | Rhoads | 37/142 |
| 4,208,816 | 6/1980 | West | 37/141 |
| 4,231,173 | 11/1980 | Davis | 37/142 |
| 4,233,761 | 11/1980 | Ryerson | 37/142 |
| 4,317,300 | 3/1982 | Emrich et al. | 37/142 |
| 4,326,348 | 4/1982 | Emrich | 37/142 |
| 4,335,532 | 6/1982 | Hahn et al. | 37/142 |
| 4,360,981 | 11/1982 | Bierwith et al. | 37/142 |
| 4,391,050 | 7/1983 | Smith et al. | 37/141 |
| 4,404,760 | 9/1983 | Hahn et al. | 37/142 |
| 4,414,764 | 11/1983 | Johansson et al. | 37/141 |
| 4,428,131 | 1/1984 | Hahn | 37/142 |
| 4,510,706 | 4/1985 | Berchem | 37/64 |
| 4,587,751 | 5/1986 | Sjogren et al. | 37/142 R |

OTHER PUBLICATIONS

"Types of Points and Adapters", issued 6/73.

*Primary Examiner*—Clifford D. Crowder

*Attorney, Agent, or Firm*—Hubbard, Thurman, Turner & Tucker

[57] ABSTRACT

An improved excavating tooth and wear cap assembly is provided in which the front pin that interconnects the replaceable point to the adapter nose is protected from undesirable deformation by interlocking stabilizing lugs and grooves formed respectively on the wear cap and adapter base portions of the assembly. The cooperation between these lugs and grooves prevents earth forces from driving the wear cap portion of the assembly forwardly along the adapter base into the point and thereby causing the point to deform the connecting pin. Field installation of a lower wear cap portion of the assembly is facilitated by the provision of cooperating support lugs on the wear cap and shoulders on the adapter which, together with a pivotal interconnection between the adapter and wear cap, permits the lower wear cap to be hung from the adapter in a temporary support position until the point can be installed and interconnected to the wear cap to complete the assembly.

14 Claims, 6 Drawing Figures

EXCAVATING TOOTH AND WEAR CAP ASSEMBLY

BACKGROUND OF THE INVENTION

The present invention relates generally to excavation apparatus, and more particularly provides a uniquely configured excavating tooth and wear cap assembly for installation on an excavating bucket, dipper or the like.

Large excavating buckets, dippers or the like are typically provided with a series of earth-cutting teeth which are each formed from two primary parts—a relatively large adapter and a relatively small replaceable point. The adapter has a base portion which is connectable to the forward lower lip of the bucket and a nose portion onto which the tooth point is removably secured by a suitable connecting pin. Compared to that of the adapter, the useful life of the point is rather short—the adapter typically lasting through five or more point replacements until the tremendous earth forces and abrasion to which it is subjected necessitates its replacement.

Since the much larger adapter is considerably more expensive than its replaceable point, efforts have been made to further prolong its life by providing it with a variety of externally mounted wear cap or plate structures which function to shield the external surface of its base portion from abrasion. When the wear cap becomes sufficiently worn it is simply replaced to thereby significantly extend the useful life of the adapter.

While a variety of known wear cap structures do indeed extend the lives of the adapters which they shield, they have heretofore created another problem in the tooth assembly which, to a substantial extent, offsets their usefulness. Specifically, the various methods previously used to connect conventional wear caps to tooth adapters permit the caps to be driven by forwardly directed earth forces into the point, thereby deforming the pointadapter connecting pin. Such deformation can render point removal extremely difficult and often necessitates premature removal and replacement of the entire tooth assembly.

Another problem associated with conventional wear caps is that they can be rather awkward and difficult to field-install on the adapter base. This is particularly true relative to wear caps which are installed on the downwardly facing surface of an adapter base and partially retained in place by the subsequently installed replaceable point. Typically, such lower wear cap (a relatively heavy structure) must be hand-held against the adapter base while the point is being slipped onto the adapter nose. Because the point is also usually quite heavy this is commonly a two-man project - one man slipping the point onto the adapter nose while another man is holding the lower wear cap temporarily in place.

In view of the foregoing it is an object of the present invention to provide an improved excavating tooth and wear cap assembly which eliminates or substantially minimizes above-mentioned and other problems and disadvantages associated with conventional tooth and wear cap assemblies.

SUMMARY OF THE INVENTION

In carrying out principles of the present invention, in accordance with a preferred embodiment thereof, an improved excavating tooth and wear cap assembly is provided which comprises an adapter having a rearwardly disposed base portion and a forwardly disposed nose portion, identically configured upper and lower wear caps, and a replaceable point. Each of the wear caps has a base wall which covers and protects one of the upper and lower exterior surfaces of the adapter base, and a pair of transverse skirt walls which cover and protect opposite exterior side surface portions of the adapter base.

Each of the wear cap base walls is pivotally connected, at a rear end portion thereof, to the adapter base by means of a pair of rearwardly projecting tabs formed on the base wall and received in lipped grooves formed in the adapter base. The point has a rearwardly opening pocket formed therein which recives the adapter nose the point being removably connected to the adapter nose by pin means extending through aligned openings formed through the point and adapter nose. When the point is installed on the adapter nose, pivotal motion of the wear cap base walls relative to the adapter base is precluded by front end tabs formed on the base walls, such tabs being received in exterior depressions in the adapter base and covered by rearwardly projecting tabs formed on the point.

With the adapter extending generally horizontally from the forwardly disposed lower lip of an excavating bucket or the like, and prior to the installation of the point of the adapter nose, the present invention uniquely facilitates the field installation of the lower wear cap on the adapter by the provision of cooperating interior support lugs on the wear cap skirt walls and exterior shoulders on the adapter. When the rear base wall tabs of the lower wear cap are inserted into the lipped adapter grooves the interior support lugs may be rested upon the exterior shoulders with the lower wear cap in a slightly pivoted position relative to the adapter. The shoulders and the adapter groove lips hold the lower wear cap in a temporary support position, thereby freeing the installer's hands to install the upper wear cap on the adapter and to lift the point and slide it onto the adapter nose.

As the point is being moved toward its final position on the nose, the lower wear cap may simply be pivoted upwardly to its final position so that the point tabs can be moved over the front tabs of the upper and lower wear cap base walls. The connecting pin means may then be driven into the adapter nose to complete the assembly.

According to another important aspect of the present invention, laterally extending interior stabilizing lugs are formed on the wear cap base walls and are received in complementarily configured stabilizing grooves formed in the upper and lower surfaces of the adapter base. The interlock between these stabilizing lugs and grooves prevents earch from driving either of the wear caps forwardly along the adapter base and against the point to thereby cause the point to undesirably deform the connecting pin means. The stabilizing lugs and grooves are relatively positioned in a manner such that they automatically interengage as the base walls are pivoted toward the adapter after the rear base wall tabs have been inserted into the lipped adapter base grooves.

DETAILED DESCRIPTION

Figure 1:
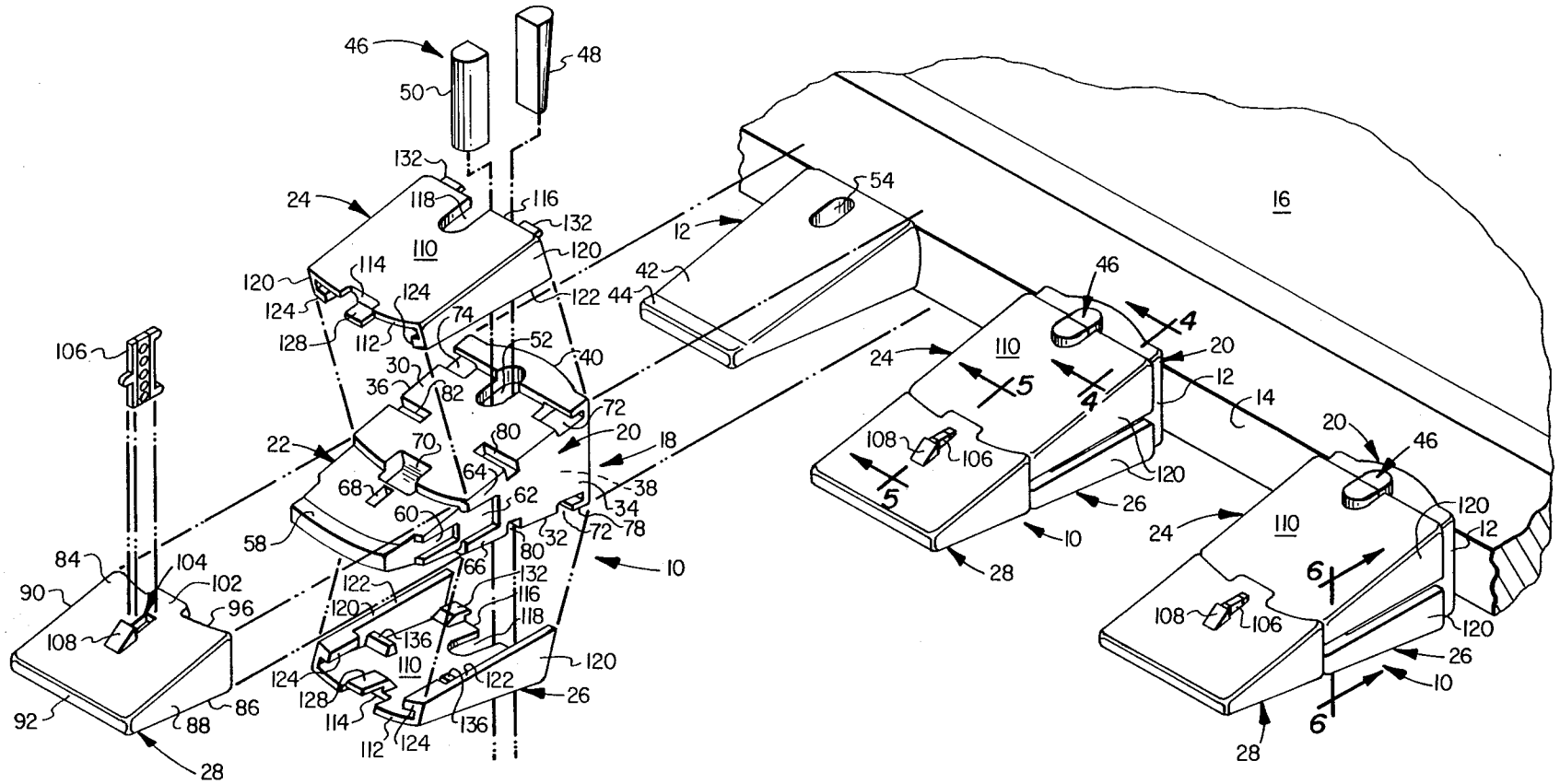
FIG. 1 is a fragmentary, partially exploded perspective view of three excavating tooth and wear cap assemblies which embody principles of the present invention and are operably connected to the forward lower lip of an excavating bucket.

Perspectively illustrated in FIG. 1 are three excavating tooth and wear cap assemblies 10 which embody principles of the present invention and are removably mountable in a subsequently described manner on suitable base members 12 welded or otherwise fixedly secured to the forward lip 14 of the lower wall 16 of an excavating bucket or the like. Each of the assemblies 10 includes an adapter 18 having a rearwardly disposed, hollow base portion 20 and a forwardly disposed nose portion 22, upper and lower wear caps 24 and 26, and a hollow, replaceable tooth point 28.

The base portion 20 of adapter 18 has a pair of forwardly converging upper and lower walls 30, 32 which are spaced apart by a pair of opposite sidewalls 34, 36. Walls 30, 32, 34 and 36 define in the base portion a pocket 38 which opens outwardly through the rear end 40 of the adapter 18. Pocket 38 is complementarily configured relative to the bucket lip base 12 which has a forwardly converging body portion 42 that terminates at its forward end in a flattened, transversely elongated stabilizing portion 44. The lip base 12 is received in the adapter pocket 38 with the adapter 18 being removably secured to the lip base 12 by rear pin means 46 in the form of a conventional wedge 48 and spool 50. The wedge and spool extend through aligned, laterally central elongated openings 52 formed through walls 30, 32 (only the upper opening 52 being visible in FIG. 1) and a similarly shaped opening 54 extending vertically through the base body portion 42.

Like the adapter base portion 20, the nose portion 22 tapers inwardly in a forward direction, and terminates at its forward end in a laterally elongated, flattened stabilizing portion 58. As illustrated in FIG. 1, the stabilizing portion 58 is laterally shorter than the balance of the nose 22 and is centered between the adapter sidewalls 34 and 36. Extending rearwardly from the stabilizing portion 58 along the opposite sides of the nose 22 are a pair of rectangularly cross-sectioned slots 60 (only one of which is illustrated in FIG. 1), each of such slots having a vertical width generally identical to that of the stabilizing portion 58. Extending rearwardly from the slots 60 along the opposite sidewalls 34, 36 are a pair of shallower and somewhat wider depressions 62, each of which defines on the adapter a pair of upper and lower shoulders 64, 66 (see FIG. 6).

To facilitate the attachment of the replaceable point 28 to the adapter nose 22 in a manner subsequently described, a laterally centered, rectangularly cross-sectioned opening 68 is formed vertically through the adapter nose 22 behind the stabilizing portion 58 thereof. Directly behind the opening 68 external depressions 70 are formed in the upper and lower surfaces of the adapter, only the upper surface depression 70 being visible in FIG. 1.

Figure 4:
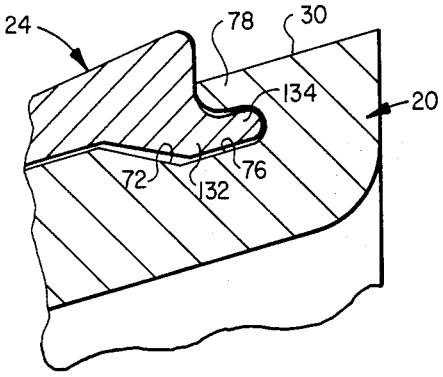
FIG. 4 is an enlarged scale cross-sectional view through one of the assemblies taken along line 4—4 of FIG. 1.

Adjacent the rear end 40 of the adapter 18 a pair of laterally extending grooves 72, 74 are formed in the upper wall 30 of the adapter base 20. The grooves 72 and 74, respectively, extend inwardly from the sidewalls 34, 36 toward the pin opening 52 and are identically configured. As best illustrated in FIG. 4, the groove 72 (like the groove 74) has a rearwardly extending portion 76 which creates in the upper adapter wall 30 a forwardly projecting lip 78. Identically configured grooves 72 and 74 are also formed in the lower adapter wall 32 and extend from the sidewalls 34, 36 toward the opening 56 in the lower wall 32. These lower grooves 72 and 74 also form wall lips 78 identical to the two lips 78 in the upper adapter wall 30.

Positioned between the depressions 70 and the laterally extending grooves 72 and 74 is an opposite pair of laterally extending grooves 80, 82 formed in the upper surface of the adapter and respectively extending inwardly from the opposite sidewalls 34 and 36. Identically configured and positioned grooves 80 and 82 are also formed on the underside of the adapter (the lower groove 82 not being visible in FIG. 1)

Figure 3:
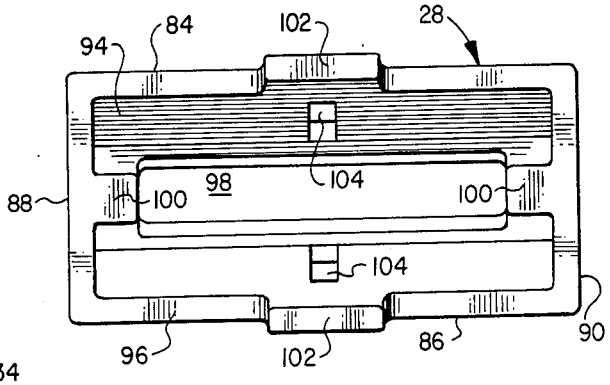
FIG. 3 is an enlarged scale back end view of the point portion of one of the assemblies and illustrates the contours of a pocket therein.

As illustrated in FIGS. 1 and 3, the hollow, replaceable point 28 is generally wedge-shaped and includes a pair of forwardly converging upper and lower walls 84 and 86 which are interconnected by sidewalls 88 and 90. At the forward end of the point 28 is a cutting edge 92. The point walls 84, 86, 88 and 90 define in a rearwardly disposed portion of point 28 a pocket 94 (FIG. 3) which opens outwardly through the rear end 96 of the point and receives the adapter nose portion 22. Point pocket 94 is complementarily configured relative to the adapter nose portion 22 and includes a forwardly extending, rectangularly cross-sectioned portion 98 which receives the nose stabilizing portion 58. The interengagement between the nose stabilizing portion 58 and the point socket portion 98 functions in a conventional manner to materially inhibit "wobble" of the point 28 relative to the adapter nose 22 and dislodgement of the point from the adapter nose. Such undesirable movement of the point relative to the adapter nose is further inhibited by the provision of a pair of lugs 100 (FIG. 3), each of which projects inwardly from one of the point sidewalls 88 and 90 and is recieved in one of the adapter nose slots 60.

Figure 5:
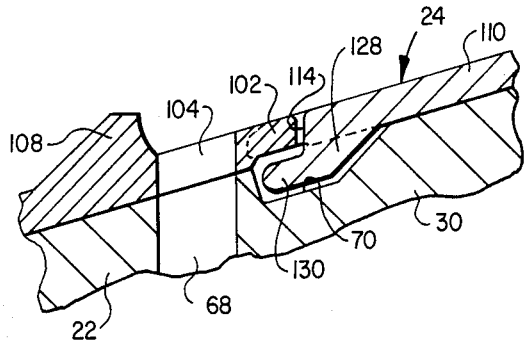
FIG. 5 is an enlarged scale cross-sectional view through one of the assemblies taken along line 5—5 of FIG. 1.

Point 28 is further provided with a pair of tabs 102, each of which projects rearwardly from a central portion of one of the upper and lower point walls 84 and 86. As best illustrated in FIG. 5, each of these tabs 102 overlies a portion of one of the depressions 70 formed in the upper and lower adapter walls 30 and 32. Adjacent the tabs 102 a pair of laterally central, aligned rectangular openings 104 are formed through the upper and lower point walls 84 and 86. With the adapter nose 22 received in the point pocket 94, the point 28 is removably secured to the adapter nose by means of a conventional flex pin 106 which is forced into and through the aligned point wall openings 104 and the adapter nose opening 68 positioned therebetween, pin 106 not being illustrated in FIG. 5. After the flex pin 106 is installed, its opposite ends project slightly outwardly through the point openings 104 and are shielded during the excavation process by a pair of conventional pin guards 108 which are formed integrally with the point 28 and project outwardly from the point walls 84 and 86 at the forward end of the wall openings 104.

Figure 2:
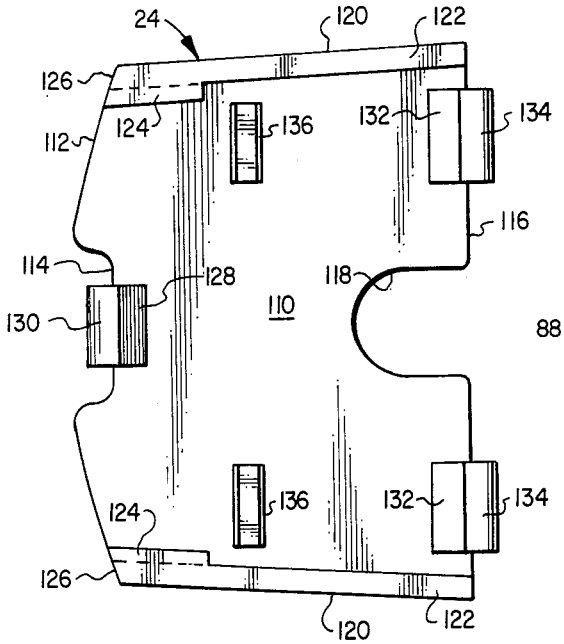
FIG. 2 is an enlarged scale plan view of the underside of the upper wear cap portion of one of the assemblies.

The upper and lower wear caps 24 and 26 are identically configured, are removably attachable to the adapter 18 as subsequently described, and function to shield the exterior of the adapter base portion 20 from abrasion during the excavating process. As illustrated in FIGS. 1 and 2, the upper wear cap 24 (like the lower wear cap 26) has a base wall 110 having an outwardly wardly curved front end 112 with a central depression 114 formed therein, and an essentially straight rear end 116 having a centrally disposed, elongated depression 118 formed therein. Projecting transversely from opposite side edge portions of the base wall 110 are a pair of skirt walls 120 which extend between the rear and front ends 112, 116 of the base wall 110 and have sloping outer end portions 122, end portions 122 of the upper wear cap 24 sloping downwardly and rearwardly, and end portions 122 of the lower wear cap 26 sloping rearwardly and upwardly. The distance between the facing inner side surfaces of the skirt walls 120 is just slightly greater than the width of the upper and lower adapter walls 30 and 32. Formed integrally with each of the skirt walls 120 is a laterally inwardly projecting support lug 124 which extends rearwardly a short distance from the front edge 126 of the skirt wall adjacent its outer end 122.

Adjacent the inner end of its front end depression 114, the base wall 110 is provided with an integral, inwardly offset retaining tab 128 having a forwardly projecting outer end portion 130 (FIGS. 2 and 3). The base wall 110 also has integrally formed therewith a pair of inwardly offset retaining tabs 132, each of the tabs 132 having rearwardly extending outer end portions 134 (FIGS. 2 and 4) and being positioned at the rear end 116 of the base wall 110 adjacent the skirt walls 120. Finally, the base wall 110 is provided with a pair of inwardly projecting stabilizing lugs 136 which extend laterally inwardly along the base wall from adjacent the skirt walls 120 slightly behind the support lugs 124.

Prior to the installation of the point 28 on the adapter nose 22, the upper and lower wear caps 24, 28 are installed on the adapter in the following manner, the installation of the upper wear cap 24 being used as an example. With the skirt walls 120 extending downwardly along the adapter sidewalls 34 and 36, and the wear cap base wall 110 positioned above the upper adapter wall 30, the wear cap 24 is moved rearwardly along the adapter with the skirt wall lugs 124 positioned somewhat below the upper adapter shoulders 64 (see FIG. 6). As the reae wear cap retaining tabs 132 approach the adapter grooves 72 and 74, the wear cap 24 is slightly pivoted in a clockwise direction as viewed in FIG. 1 and the tabs 132 are inserted in the lipped adapter grooves 72 and 74. The wear cap 24 is then pivoted downwardly in a counterclockwise direction, generally about the upper groove lips 78, until the front retaining tab 128 enters the upper adapter depression 70, the wear cap stabilizing lugs 136 enter the laterally extending grooves 80 and 82 formed in the upper surface of the adapter, and the outer tab portions 134 (FIG. 4) are moved to below the upper groove lips 76.

The lower wear cap 26 is installed (either before or after the installation of the upper wear cap) in a similar manner. Specifically, the rear retaining tabs 132 of the lower wear cap are pivoted into the lower adapter grooves 72, 74 and the lower wear cap is then pivoted upwardly in a clockwise direction to position the wear cap tab 128 into the lower adapter depression 70 and to position the lower wear cap stabilizing lugs 136 within the lower adapter grooves 80. In this position the base wall depressions 118 overlie and are generally aligned with forward portions of the base openings 54 (FIG. 1).

With the upper and lower wear caps 24, 26 installed and positioned in this manner, the point 28 is pushed onto the adapter nose portion 22 so that the point tabs 102 overlie the wear cap front tabs 130 as illustrated in FIG. 5 and are received in the base wall depressions 114, and the point openings 104 are aligned with the nose opening 68. The flex pin 108 is then driven into these aligned openings to intersecure the point 28 and the adapter nose 22, thereby completing the tooth and wear cap assembly 10.

Figure 6:
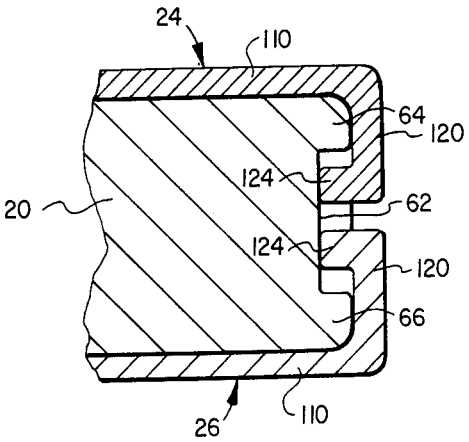
FIG. 6 is an enlarged scale cross-sectional view through one of the assemblies taken along line 6—6 of FIG. 1.

It will be appreciated that the interlocking rear wear cap tabs 132 and adapter grooves 72, 74 pivotally connect the wear caps to the adapter, but the point tabs 102 (which overlie the front wear cap tab portions 130 as illustrated in FIG. 5) preclude the pivotal motion of the wear caps relative to the adapter in the assembly 10. However, as the lower wear cap 26 is being installed, its weight tends to pivot it downwardly about the lower adapter lips 78. The amount of such downward pivoting which can occur, though, is limited by the lower adapter shoulders 66 which are positioned beneath the lower wear cap support lugs 124. With the lower wear cap 26 pivoted downwardly from its position indicated in FIG. 6, the lower shoulders 66 (only one of which is depicted in FIG. 6) engage the support lugs 124 of lower wear cap 26 and (together with the lower adapter lips 78) hold the lower wear cap on the adapter prior to the installation of the point 28.

The importance of this unique wear cap-supporting feature of the present invention is that the lower wear cap 24 (like the other components of the assembly) is quite heavy. Accordingly, it would be difficult and somewhat awkward for an installer to hold the lower wear cap in place with one hand while installing the point with the other hand. It can be seen, however, that due to the interaction between the lower shoulders 66 and the support lugs 124 of the lower wear cap (such lower shoulders 66 acting as stops for the support lugs 124), the lower wear cap may be temporarily supported on the adapter (in its previously described slightly downwardly pivoted position) until the point 28 can be lifted up to the adapter nose 22. The lower wear cap can then be pivoted slightly upwardly from its temporary support position to allow the point 28 to be slipped onto the nose 22 so that the point tabs 102 overlie and restrain the front wear cap tabs 128. This unique aspect of the present invention converts the previously awkward task of attaching the lower wear plate to the adapter (often a two man task) to a considerably easier task which usually requires only one man to accomplish.

As illustrated in FIG. 1, the base walls 110 of the installed wear caps 24, 26 shield the upper and lower surfaces of the adapter base 20 from abrasion, while the skirt walls 120 extend along and shield the side surfaces of the adapter base in a similar manner. The cooperation between the retaining tabs 128, 132 and the point tabs 102 and the adapter lips 78 which overlie them, prevents appreciable vertical movement of the wear caps relative to the adapter. Similarly, the skirt walls 120 of the wear caps additionally function to restrain the wear caps against significant side-to-side movement relative to the adapter.

The present invention further solves yet another problem associated with tooth and wear cap assemblies of conventional construction. In addition to the other very large earth forces which the assembly 10 must endure, the wear caps 24, 26 are subjected during the excavation process to forces which tend to drive them forwardly against the replaceable point 28. This forwardly directed force is particularly critical relative to the upper wear cap 24, and usually occurs as large amounts of earth are dumped from the excavating bucket downwardly along the upper wear cap. In conventionally constructed tooth and wear cap assemblies, this earth being dumped from the bucket can drive the upper wear cap into the point with sufficient force to deform the front pin which intersecures the point and the adapter nose. Deformation of such pin can render its removal extremely difficult and timeconsuming. In fact, if the front pin is sufficiently deformed it becomes necessary to remove the adapter from the bucket lip base and replace it with another adapter, resulting in expensive additional equipment downtime.

This potential pin deformation problem is substantially eliminated in the present invention by virtue of its unique provision of the rigid interlock between the stabilizing lugs 136 in the wear caps and the upper and lower adapter groove pairs 80 and 82. The stabilizing lugs 136 function to provide a secure interconnection between the wear caps and the adapter to prevent appreciable forward or rearward movement of the wear caps relative to the adapter. This, in turn, prevents either of the wear caps from being driven forwardly against the point 28 to thereby protect the pin 106 from undersirable deformation. As previously described, the lugs 136 and the grooves 80, 82 are conveniently positioned relative to one another so that they automatically interlock during the installation of the wear caps on the adapter.

The foregoing detailed description is to be clearly understood as given by way of illustration and example only, the spirit and scope of the present invention being limited solely by the appended claims.

What is claimed is:

1. An excavating tooth and wear cap assembly comprising:

an adapter having a forwardly disposed nose portion and a rearwardly disposed base portion;

a tooth point having a pocket formed therein and receiving said nose portion of said adapter;

pin means extending through and releasably intersecuring said tooth point and said nose of said adapter;

wear cap means removably carried by said base portion of said adapter adjacent said tooth point for shielding an external surface portion of said base portion of said adapter from abrasion;

interlocking means on said wear cap means and said base portion of said adapter for preventing said wear cap means from being driven against said tooth point and thereby deforming said pin means;

lipped groove means formed on a rear portion of said base portion of said adapter;

tab means formed on a rear portion of said wear cap means, said tab means being received in said lipped groove means and pivotally connecting said wear cap means to said base portion of said adapter; and tab means formed on a forward portion of said wear cap means and cooperating with said tooth point to prevent appreciable pivotal motion of said wear cap means relative to said adapter.

2. The assembly of claim 1 wherein said interlocking means comprise groove means formed in one of said wear cap means and said base portion of said adapter, and lug means formed on the other of said wear cap means and said base portion of said wear cap means and received in said groove means.

3. The assembly of claim 2 wherein said lug means are formed on said wear cap means.

4. The assembly of claim 1 further comprising cooperating means on said wear cap means and said adapter for permitting only a limited amount of pivotal motion of said wear cap means relative to said adapter, and for cooperating with said lipped groove means to support said wear cap means in a temporary support position, prior to the installation of said tooth point on said nose portion of said adapter.

5. An excavating tooth and wear cap assembly comprising:

an adapter having a forwardly disposed nose portion and a rearwardly disposed base portion, said nose portion having a flattened forward end and a duality of mutually spaced stabilizing grooves adjacent thereto, said base portion having upper and lower exterior surfaces and a pair of opposite exterior side surfaces, said upper and lower exterior surfaces each having a depression formed therein in a forward portion thereof, a pair of laterally extending lipped grooves in a rearward portion thereof, and a pair of laterally extending stabilizing grooves positioned between said depression and said lipped grooves, said pair of opposite exterior side surfaces each having a forwardly disposed depression defining a pair of mutually spaced shoulders;

an upper wear cap having a base wall extending along said upper exterior surface of said base portion of said adapter and having a front end tab received in said depression in said upper exterior surface, a pair of rear end tabs received in said lipped grooves in said upper exterior surface and pivotally mounting said base wall on said base portion of said adapter, and a pair of stabilizing lugs received in said pair of stabilizing grooves in said upper exterior surface, said base wall further having a pair of skirt walls each extending along an upper portion of one of said exterior side surfaces and having a support lug formed thereon and positioned between and spaced from the shoulders in one of said pairs of said shoulders:

a lower wear cap having a base wall extending along said lower exterior surface of said base portion of said adapter and having a front end tab received in said depression in said lower exterior surface, a pair of rear end tabs received in said lipped grooves in said lower exterior surface and pivotally mounting said base wall of said lower wear cap on said base portion of said adapter, and a pair of stabilizing lugs received in said pair of stabilizing grooves in said lower exterior surface, said base wall of said lower wear cap further having a pair of skirt walls each extending along a lower portion of one of said exterior side surfaces and having a support lug formed thereon and positioned between and spaced from the shoulders in one of said pairs of said shoulders;

a replaceable point having a pocket receiving said nose portion of said adapter, said pocket having a forwardly projecting portion which receives said flattened forward end of said nose portion of said adapter, and a pair of inwardly projecting stabilizing lugs each received in one of said duality of stabilizing grooves in said nose portion, said point further having a pair of rearwardly projecting tabs each overlying one of said front tabs of said upper and lower wear caps; and pin means extending through and releasably intersecuring said point and said nose portion of said adapter.

6. A wear cap for installation on the base portion of an excavating tooth adapter having a nose portion configured for removable connection to a replaceable tooth point, said wear cap comprising:

a base wall having a front end, a rear end, a pair of mutually spaced side edge portions and an inner surface facing in a first direction;

a pair of skirt walls extending transversely from said side edge portions of said base wall in said first direction;

means adjacent said rear end of said base wall for pivotally connecting said base wall to said base portion of said adapter;

means adjacent said front end of said base wall for cooperating with said tooth point to prevent appreciable pivotal motion of said wear cap relative to said adapter; and means for interlocking said wear cap with said base portion of said adapter in a manner preventing appreciable movement of said wear cap relative to said base portion toward said tooth point, said means for pivotally connecting comprising at least one rear tab offset inwardly from said base wall and having a rearwardly extending outer end portion, and said means for cooperating with said tooth point comprising at least one front tab offset inwardly from said base wall and having a forwardly extending outer end portion.

7. The wear cap of claim 6 wherein said means for interlocking comprise lug means projecting inwardly from said inner surface of said base wall.

8. The wear cap of claim 7 wherein said lug means comprise a pair of stabilizing lugs each extending laterally inwardly from adjacent different one of said pair of skirt walls.

9. The wear cap of claim 8 wherein said stabilizing lugs are positioned generally centrally between said front and rear ends of said base wall.

10. The wear cap of claim 6 wherein:

said means for pivotally connecting comprise two rear tabs each positioned adjacent a different one of said skirt walls.

11. The wear cap of claim 10 wherein:

said means for cooperating with said tooth point comprise a single front tab positioned generally centrally between said skirt walls.

12. The wear cap of claim 6 further comprising means for cooperating with said base portion of said adapter to permit only a limited amount of pivotal motion of said wear cap relative to said adapter when said tooth point is removed from said nose portion of said adapter.

13. The wear cap of claim 12 wherein said means for cooperating with said base portion of said adapter comprise support lug means carried by at least one of said skirt walls.

14. The wear cap of claim 13 wherein:

said skirt walls each have an outer end portion, and said means for cooperating with said base portion of said adapter comprise a pair of support lugs each projecting laterally inwardly from a different one of said outer end portions of said skirt walls along a forwardly disposed portion thereof.

* * * * *